US009432765B2

(12) United States Patent
Akino

(10) Patent No.: US 9,432,765 B2
(45) Date of Patent: Aug. 30, 2016

(54) CONDENSER MICROPHONE

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 667 days.

(21) Appl. No.: 13/874,778

(22) Filed: May 1, 2013

(65) Prior Publication Data

US 2013/0322637 A1 Dec. 5, 2013

(30) Foreign Application Priority Data

May 31, 2012 (JP) ..... 2012-125239

(51) Int. Cl.
*H04R 3/00* (2006.01)
*H04R 25/00* (2006.01)
*H04R 19/04* (2006.01)

(52) U.S. Cl.
CPC ..... *H04R 3/00* (2013.01); *H04R 3/005* (2013.01); *H04R 19/04* (2013.01)

(58) Field of Classification Search
CPC ..... H04R 3/00; H04R 3/005; H04R 19/04; H04R 2410/00; H04R 2410/03
USPC ..... 381/111, 113, 122, 174, 191, 369
See application file for complete search history.

(56) References Cited

U.S. PATENT DOCUMENTS

2011/0194703 A1* 8/2011 Akino ..... H04R 3/04 381/26

FOREIGN PATENT DOCUMENTS

JP 2006-101302 4/2006

* cited by examiner

*Primary Examiner* — Vivian Chin
*Assistant Examiner* — Douglas Suthers
(74) *Attorney, Agent, or Firm* — Whitham, Curtis & Cook, P.C.

(57) ABSTRACT

A condenser microphone outputs a signal resistive to distortion caused by an excess input without a variation in signal-to-noise ratio. The microphone includes a first condenser microphone unit and a second condenser microphone unit that generate output signals having phases opposite to each other; and a twin variable resistor connected to an output terminal of each of the first and second condenser microphone units. In the microphone, the output signal of the first unit is combined with the output signal of the second unit in a first variable resistor included in the twin variable resistor and the composite signal is applied to an input of the first unit, and the output signal of the first unit is combined with the output signal of the second unit in a second variable resistor included in the twin variable resistor and the composite signal is applied to an input of the second unit.

8 Claims, 9 Drawing Sheets

NORMALIZED dBV AMPLITUDE vs FREQUENCY

CONDENSER MICROPHONE

TECHNICAL FIELD

The present invention relates to a condenser microphone that can adjust an input level to an impedance converter without deterioration of the signal-to-noise ratio of an output signal.

BACKGROUND ART

A condenser microphone includes a condenser microphone unit functioning as an electro-acoustic transducer having high impedance and thus needs an impedance converter including, for example, a field-effect transistor (hereinafter referred to as "FET"). An impedance converter needs an operation power source. The voltage of the operation power source limits the maximum output level of the condenser microphone. This causes distortion of an output signal when the acoustic pressure of sound waves inputted to the condenser microphone unit is so high as to exceed the maximum output level of the unit.

Such distortion of an output signal is prevented using an attenuator called a "pad" attenuating the input level to the impedance converter. The pad includes a capacitor connected in parallel to the condenser microphone unit and attenuates the input signal level of the impedance converter in response to the ratio of capacitance of the capacitor to that of the condenser microphone unit. This can prevent an excessive input to the impedance converter.

Meanwhile, the impedance converter generates inherent noise. The noise level is constant independent of an input signal level. This decreases the signal-to-noise ratio of a condenser microphone output when the pad is used to attenuate the input level to the impedance converter for prevention of distortion due to an excessive input.

A conventional condenser microphone is known that prevents a decrease in the signal-to-noise ratio by converting an unbalanced output of the impedance converter into a balanced output to reduce the distortion of an audio signal outputted from the impedance converter (for example, see Japanese Unexamined Patent Application Publication No. 2006-101302).

SUMMARY OF INVENTION

Technical Problem

A condenser microphone described in Japanese Unexamined Patent Application Publication No. 2006-101302 can offset the second-order distortion of the impedance converter to reduce output distortion. A pad is however necessary for inputted sound waves having excessive acoustic pressure above the maximum output level, and thus cannot avoid a decrease in the signal-to-noise ratio.

As illustrated in FIG. 9, another conventional condenser microphone is also known that can switch the function (active or inactive) of the pad in response to the amplitude of an input level. A condenser microphone 100 as illustrated in FIG. 9 includes a first condenser microphone unit 21, a second condenser microphone unit 22, a first impedance converter 31, a second impedance converter 32, and a pad 40. The pad 40 includes a first capacitor 41, a second capacitor 42, and two switches 43 and 43 activating or deactivating the capacitors 41 and 42.

The condenser microphone unit 21 includes a fixed electrode 212 connected to the input terminal of the impedance converter 31. The first capacitor 41 for the pad is connected in parallel to the condenser microphone unit 21 through the single switch 43. The condenser microphone unit 22 includes a diaphragm 221 connected to the input terminal of the impedance converter 32. The second capacitor 42 for the pad is connected in parallel to the condenser microphone unit 22 through the single switch 43. The condenser microphone unit 21 has a diaphragm 211 grounded while the condenser microphone unit 22 has a fixed electrode 222 grounded.

The first and second capacitors 41 and 42 can be connected or disconnected by one of the switches 43 to turn on or off the pad including the capacitors 41 and 42. If a low acoustic pressure level of sound waves is inputted to the condenser microphone 100, the switch 43 is turned off to deactivate the pad 40. If a high acoustic pressure level of sound waves is inputted, the switch 43 is turned on to activate the pad 40. The pad 40 is appropriately activated or deactivated by a user operation of the switch 43.

Using a pad 40 including multiple switches and capacitors having different capacitances, changes in capacitances of these capacitors by the switches can provide a gradual attenuation of the input signal level to the impedance converter. Unfortunately, this configuration cannot provide a continuously variable attenuation value. Since a signal is not amplified by the impedance converter, the signal-to-noise ratio cannot be maintained at a low level even if the input level to the impedance converter is low.

It is an object of the present invention to provide a condenser microphone that can function as a pad for excess acoustic pressure and continuously increase the signal level in response to a low input level without a variation in signal-to-noise ratio.

Solution to Problem

A condenser microphone according to the present invention includes a first condenser microphone unit and a second condenser microphone unit that generate output signals having phases opposite to each other; and a twin variable resistor connected to an output terminal of each of the first condenser microphone unit and the second condenser microphone unit. In the condenser microphone, the output signal of the first condenser microphone unit is combined with the output signal of the second condenser microphone unit in a first variable resistor included in the twin variable resistor and the composite signal is applied to an input of the first condenser microphone unit, and the output signal of the first condenser microphone unit is combined with the output signal of the second condenser microphone unit in a second variable resistor included in the twin variable resistor and the composite signal is applied to an input of the second condenser microphone unit.

Advantageous Effects of Invention

A condenser microphone according to the present invention can provide a continuously variable attenuation value without a variation in signal-to-noise ratio even when the input level to the impedance converter is attenuated.

DESCRIPTION OF EMBODIMENTS

Figure 1:
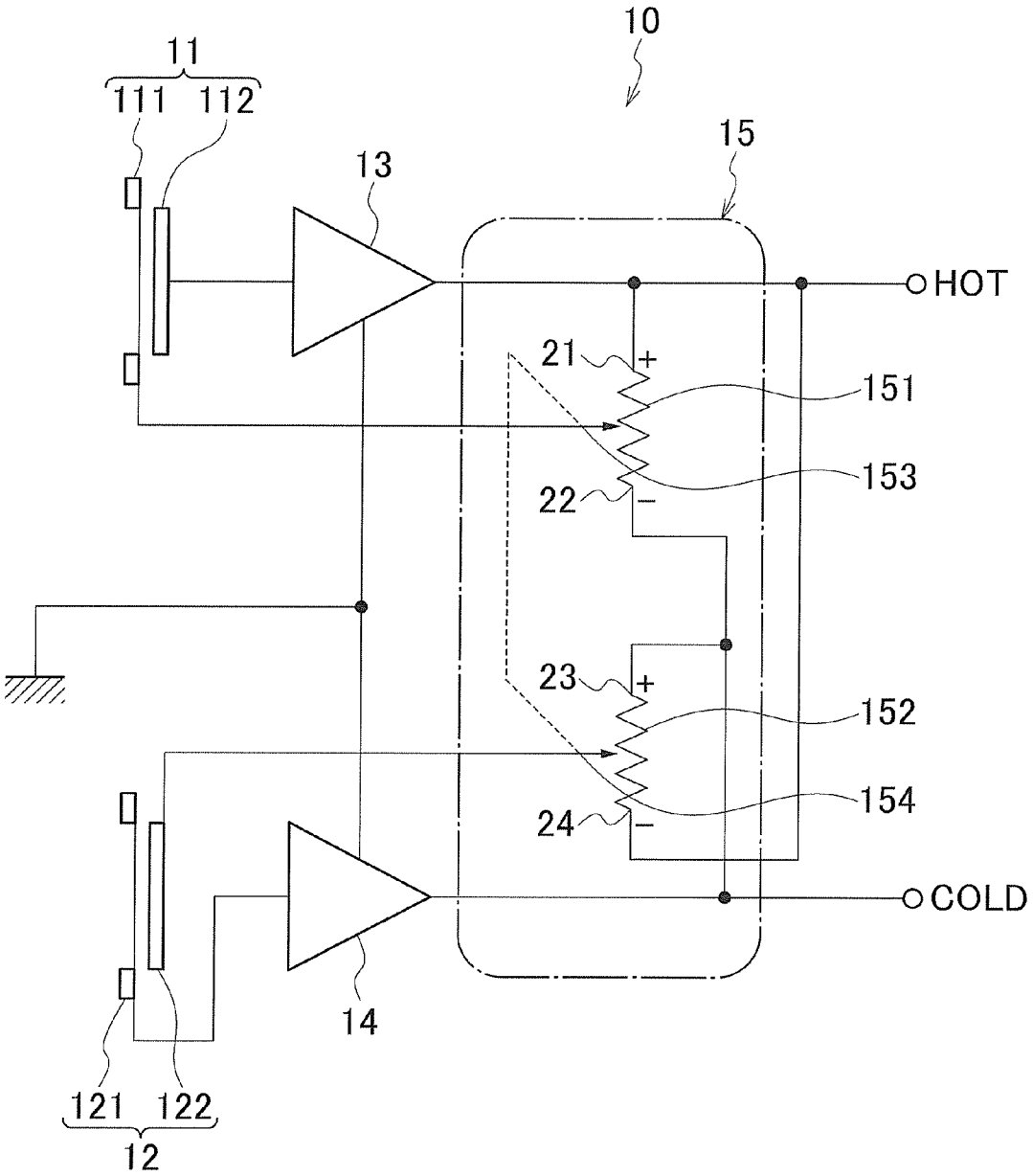
FIG. 1 is a circuit diagram illustrating a condenser microphone according to an embodiment of the present invention.

A condenser microphone according to an embodiment of the present invention will now be described with reference to the accompanying drawings. With reference to FIG. 1, a condenser microphone 10 includes a first condenser microphone unit 11, a second condenser microphone unit 12, a first impedance converter 13, a second impedance converter 14, and a twin variable resistor 15.

The first condenser microphone unit 11 includes a diaphragm 111 and a fixed electrode 112. The diaphragm 111 and the fixed electrode 112 are separated by a spacer (not illustrated) defining a predetermined gap and are accommodated in a microphone case (not illustrated). The second condenser microphone unit 12 includes a diaphragm 121 and a fixed electrode 122. The diaphragm 121 and the fixed electrode 122 are separated by a spacer (not illustrated) defining a predetermined gap and are accommodated in the microphone case (not illustrated).

The first and second impedance converters 13 and 14 each include an FET as an active element for impedance conversion. In the first condenser microphone unit 11 functioning as a fixed electrode output, the fixed electrode 112 as an output terminal is connected to the gate terminal of the FET as an input terminal of the first impedance converter 13. In the second condenser microphone unit 12 functioning as a diaphragm output, the diaphragm 121 as an output terminal is connected to the gate terminal of the FET as an input terminal of the second impedance converter 14.

The output signal of the first condenser microphone unit 11 is outputted from the drain terminal of the FET as an output terminal of the first impedance converter 13. The output signal of the second condenser microphone unit 12 is outputted from the drain terminal of the FET as an output terminal of the second impedance converter 14. The first condenser microphone unit 11 functions as a fixed electrode output while the second condenser microphone unit 12 functions as a diaphragm output. In other words, the output signal of the first condenser microphone unit 11 has a phase opposite to that of the output signal of the second condenser microphone unit 12. The condenser microphone 10 thus generates a balanced output. As illustrated in FIG. 1, the output terminal of the first impedance converter 13 functions as a hot terminal of the balanced output while the output terminal of the second impedance converter 14 functions as a cold terminal of the balanced output.

The variable resistor 15 is connected between the output terminals of the first and second impedance converters 13 and 14. The twin variable resistor 15 includes a first variable resistor 151 and a second variable resistor 152. The first variable resistor 151 includes a wiper 153 interlocked with a wiper 154 of the second variable resistor 152.

The first variable resistor 151 is connected between the output terminal of the first impedance converter 13 (the output terminal for the first condenser microphone unit 11) and the output terminal of the second impedance converter 14 (the output terminal for the second condenser microphone unit 12). The second variable resistor 152 is connected between the output terminal of the second impedance converter 14 (the output terminal for the second condenser microphone unit 12) and the output terminal of the first impedance converter 13 (the output terminal for the first condenser microphone unit 11).

Hereinafter, a terminal of the first variable resistor 151 adjacent to the first impedance converter 13 is referred to as a "first terminal 21", a terminal of the first variable resistor 151 adjacent to the second impedance converter 14 to as a "second terminal 22", a terminal of the second variable resistor 152 adjacent to the second impedance converter 14 to as a "third terminal 23", and a terminal of the second variable resistor 152 adjacent to the first impedance converter 13 to as a "fourth terminal 24". Hereinafter, the first and third terminals 21 and 23 are designated with a "positive end" while the second and fourth terminals 22 and 24 are designated with a "negative end".

The first terminal 21 of the first variable resistor 151 is connected to the fourth terminal 24 of the second variable resistor 152 while the second terminal 22 of the first variable resistor 151 is connected to the third terminal 23 of the second variable resistor 152.

The "interlock" between the first and second wipers 153 and 154 will be described below. The shift of the first wiper 153 toward the first terminal 21 leads to the shift of the second wiper 154 toward the third terminal 23. The shift of the first wiper 153 toward the second terminal 22 leads to the shift of the second wiper 154 toward the fourth terminal 24. The shift of the second wiper 154 toward the third terminal 23 leads to the shift of the first wiper 153 toward the first terminal 21. The shift of the second wiper 154 toward the fourth terminal 24 leads to the shift of the first wiper 153 toward the second terminal 22. In this way, the first and second variable resistors 151 and 152 constitute a twin variable resistor including the first and second wipers 153 and 154 shifted in cooperation with each other.

The first wiper 153 is connected to the diaphragm 111 of the first condenser microphone unit 11. The second wiper 154 is connected to the fixed electrode 122 of the second condenser microphone unit 12.

The diaphragm 111 of the first condenser microphone unit 11 is supplied with a composite signal including output signals of the first and second condenser microphone units 11 and 12 through the first wiper 153. The output signal of the first condenser microphone unit 11 has a phase opposite to that of the output signal of the second condenser microphone unit 12. Resistance values on the positive end and the negative end of the first variable resistor 151 are determined by a position of the first wiper 153 and affect the output signal of the first and second condenser microphone units 11 and 12. Output signal levels, which have phases opposite to each other, of the first and second condenser microphone units 11 and 12 are determined depending on the position of the first wiper 153. The output signals having phases opposite to each other are combined.

Similarly, the fixed electrode 122 of the second condenser microphone unit 12 is supplied with a composite signal including output signals of the first and second condenser microphone units 11 and 12 through the second wiper 154. As described above, the output signal of the second condenser microphone unit 12 has a phase opposite to that of the output signal of the first condenser microphone unit 11. Resistance values, which affect the respective output signals, on the positive end and the negative end of the second variable resistor 152 are determined by the position of the second wiper 154. Output signal levels, which have phases opposite to each other, of the first and second condenser microphone units 11 and 12 are determined depending on a position of the second wiper 154. The output signals having phases opposite to each other are combined.

As illustrated in FIG. 1, when the first and second wipers 153 and 154 are positioned at the middle points of the first and second variable resistors 151 and 152, respectively, the first variable resistor 151 provides the same resistance values for respective output signals from the first and second condenser microphone units 11 and 12. The output signal from the first condenser microphone unit 11 therefore offsets the output signal from the second condenser microphone unit 12. As a result, a composite signal does not flow through the first wiper 153. This does not supply the diaphragm 111 with either an in-phase signal or an opposite phase signal relative to the output signal of the first condenser microphone unit 11.

Similarly, the second variable resistor 152 provides the same resistance values for respective output signals from the second and first condenser microphone units 12 and 11. The output signal from the second condenser microphone unit 12 therefore offsets the output signal from the first condenser microphone unit 11. As a result, a composite signal does not flow through the second wiper 154. This does not supply the fixed electrode 122 with either an in-phase signal or an opposite phase signal relative to the output signal of the second condenser microphone unit 12.

In this way, when the first and second wipers 153 and 154 are positioned at the middle points of the first and second variable resistors 151 and 152, respectively, the output signals from the first and second condenser microphone units 11 and 12 do not either increase or decrease, are inputted to the first and second impedance converters 13 and 14, and are provided as a balanced output from the hot and cold terminals.

Figure 6:
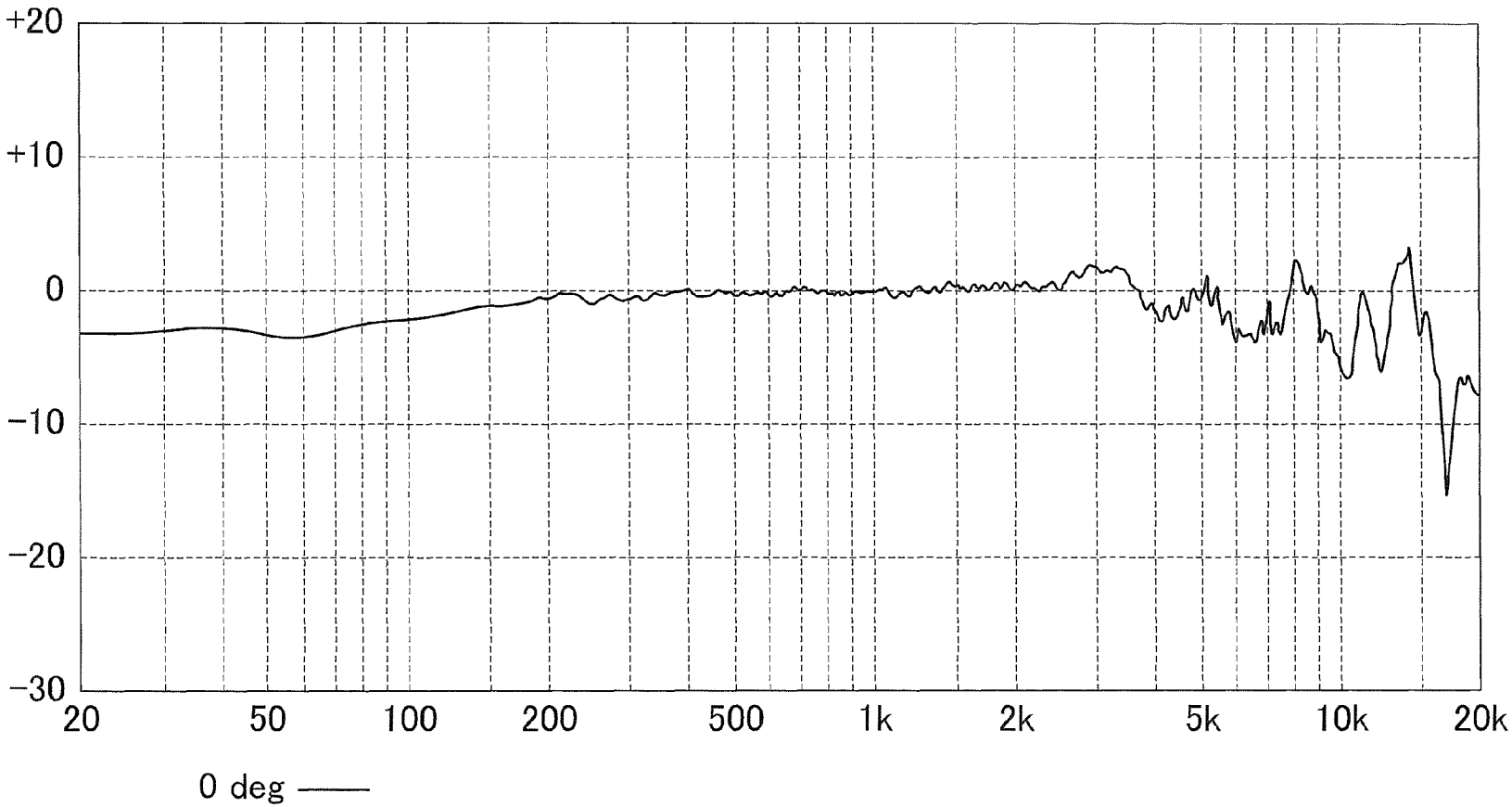
FIG. 6 is a graph illustrating frequency response characteristics when each wiper of the twin variable resistor is positioned at the middle point in the embodiment.

FIG. 6 illustrates typical frequency response characteristics of the condenser microphone 10 when the first and second wipers 153 and 154 are positioned at the middle points of the first and second variable resistors 151 and 152, respectively.

Figure 2:
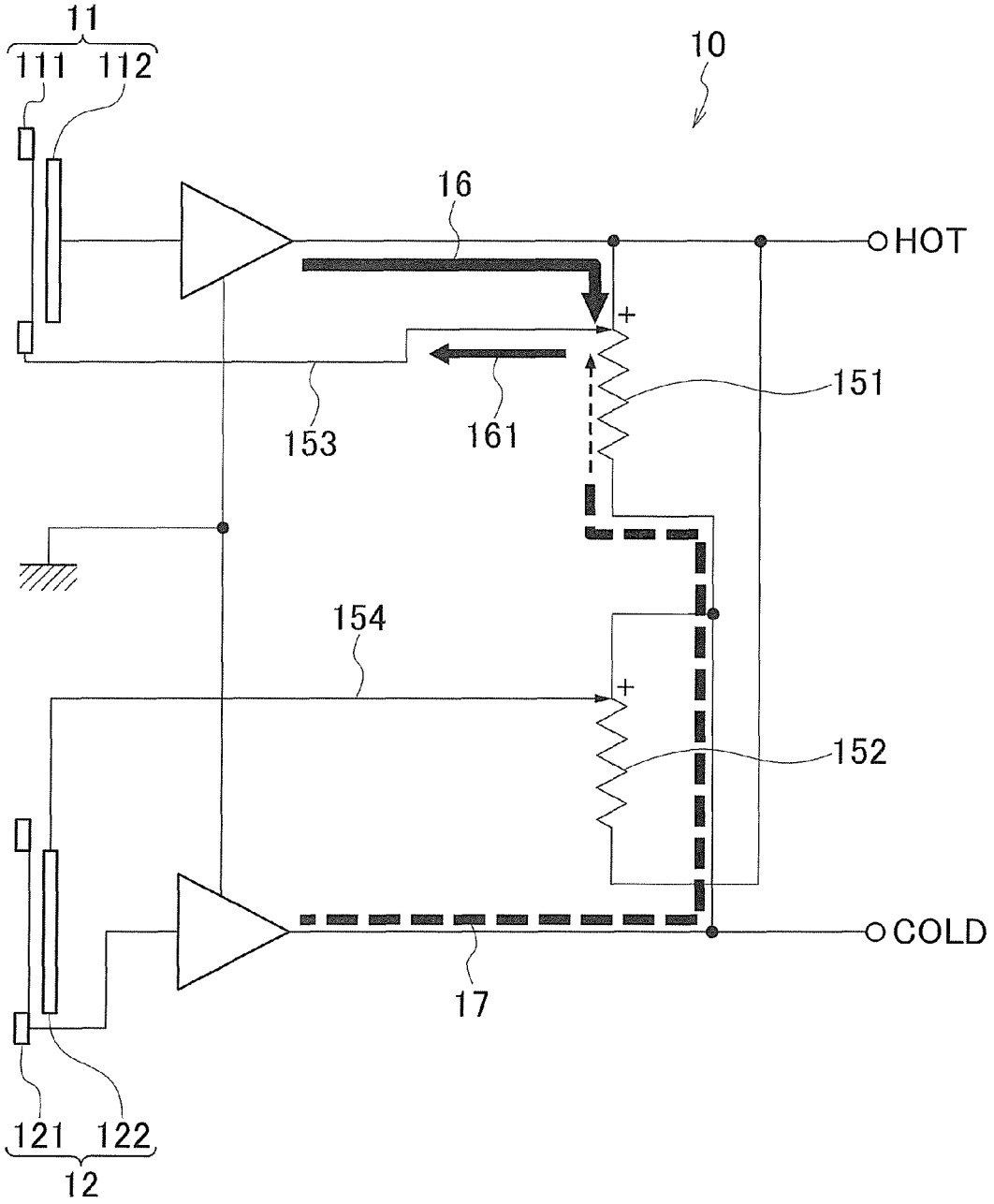
FIG. 2 is a circuit diagram illustrating an operation when each wiper of a twin variable resistor is shifted toward one terminal of the variable resister in the embodiment.
Figure 3:
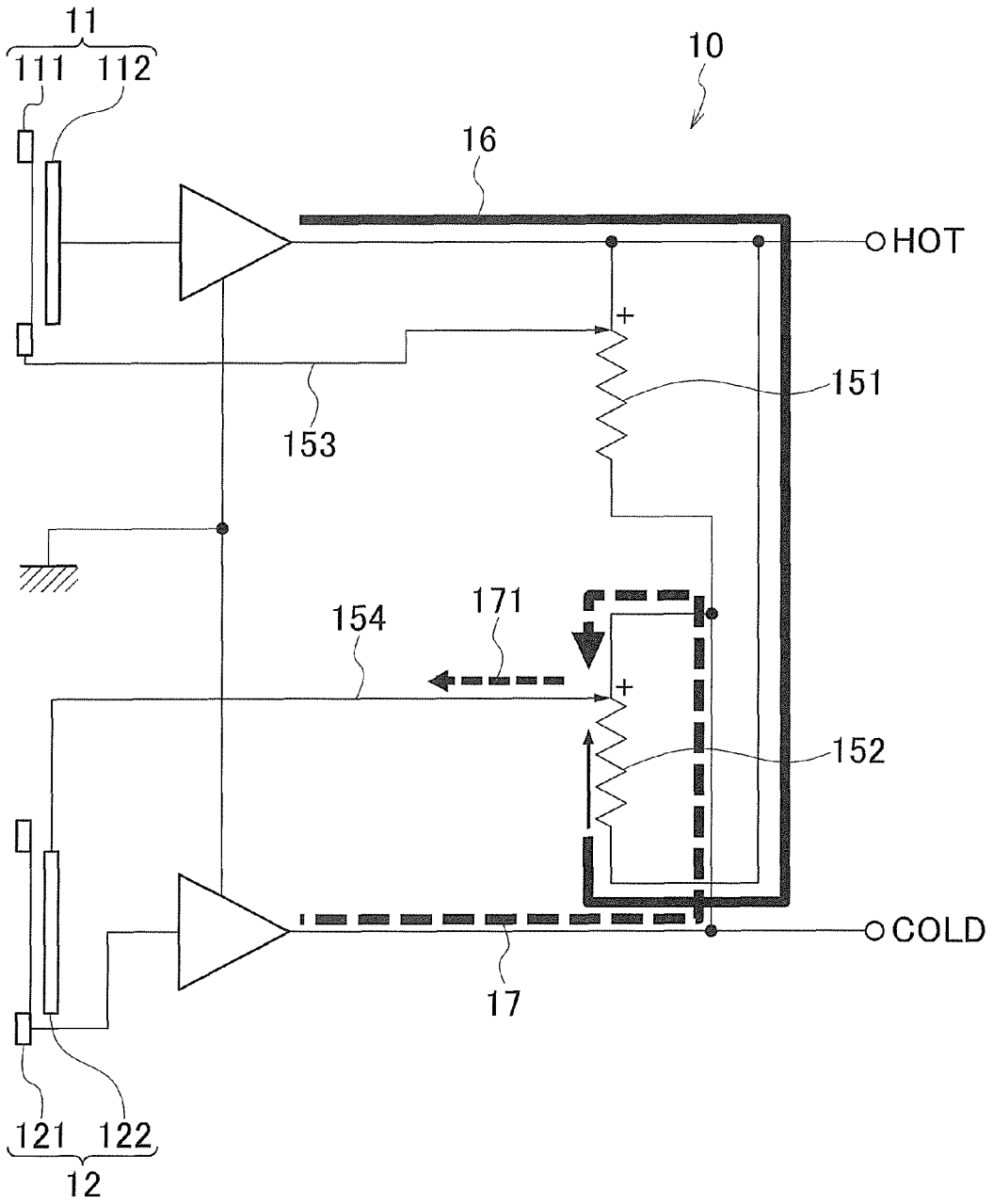
FIG. 3 is a circuit diagram illustrating another operation when each wiper of the twin variable resistor is shifted toward one terminal of the variable resister in the embodiment.

The output signal of the condenser microphone 10 will now be explained after the first and second wipers 153 and 154 are shifted from the middle point. FIGS. 2 and 3 illustrate exemplary states of the condenser microphone 10 after the first and second wipers 153 and 154 are shifted to the positive end.

The output signal 16 of the first condenser microphone unit 11 and the output signal 17 of the second condenser microphone unit 12 are combined after being attenuated in proportion to the resistance value of the first variable resistor 151 into a composite signal 161 to be applied to the diaphragm 111 through the first wiper 153. As illustrated in FIG. 2, after the first wiper 153 is shifted to the positive end, the first variable resistor 151 applies a minimum resistance value to the output signal 16 and a maximum resistance value to the output signal 17. At this time, the composite signal 161 to be applied to the diaphragm 111 from the first wiper 153 contains a maximum proportion of signal component in phase with the output signal 16 of the first condenser microphone unit 11. This increases the output level from the fixed electrode 112 of the first condenser microphone unit 11.

The output signal 16 of the first condenser microphone unit 11 and the output signal 17 of the second condenser microphone unit 12 are combined after being attenuated in proportion to the resistance value of the second variable resistor 152 into a composite signal 171 to be applied to the fixed electrode 122 through the second wiper 154. As illustrated in FIG. 3, after the second wiper 154 is shifted to the positive end, the second variable resistor 152 applies a maximum resistance value to the output signal 16 and a minimum resistance value to the output signal 17. At this time, the composite signal 171 to be applied to the fixed electrode 122 from the second wiper 154 contains a maximum proportion of signal component in phase with the output signal 17 of the second condenser microphone unit 12. This raises the output level from the diaphragm 121 of the second condenser microphone unit 12.

In this way, the shift of the first wiper 153 toward the positive end decreases the resistance value of the first variable resistor 151 in accordance with the output of the first condenser microphone unit 11, leading to the shift of the second wiper 154 toward the positive end together. This increases the resistance value of the first variable resistor 151 in accordance with the output of the second condenser microphone unit 12, increases the resistance value of the second variable resistor 152 in accordance with the output of the first condenser microphone unit 11, and decreases the resistance value of the second variable resistor 152 in accordance with the output of the second condenser microphone unit 12. That is, a change in the resistance value of the twin variable resistor 15 can continuously increase the levels of the input signal to the first impedance converter 13 and the input signal to the second impedance converter 14.

Figure 7:
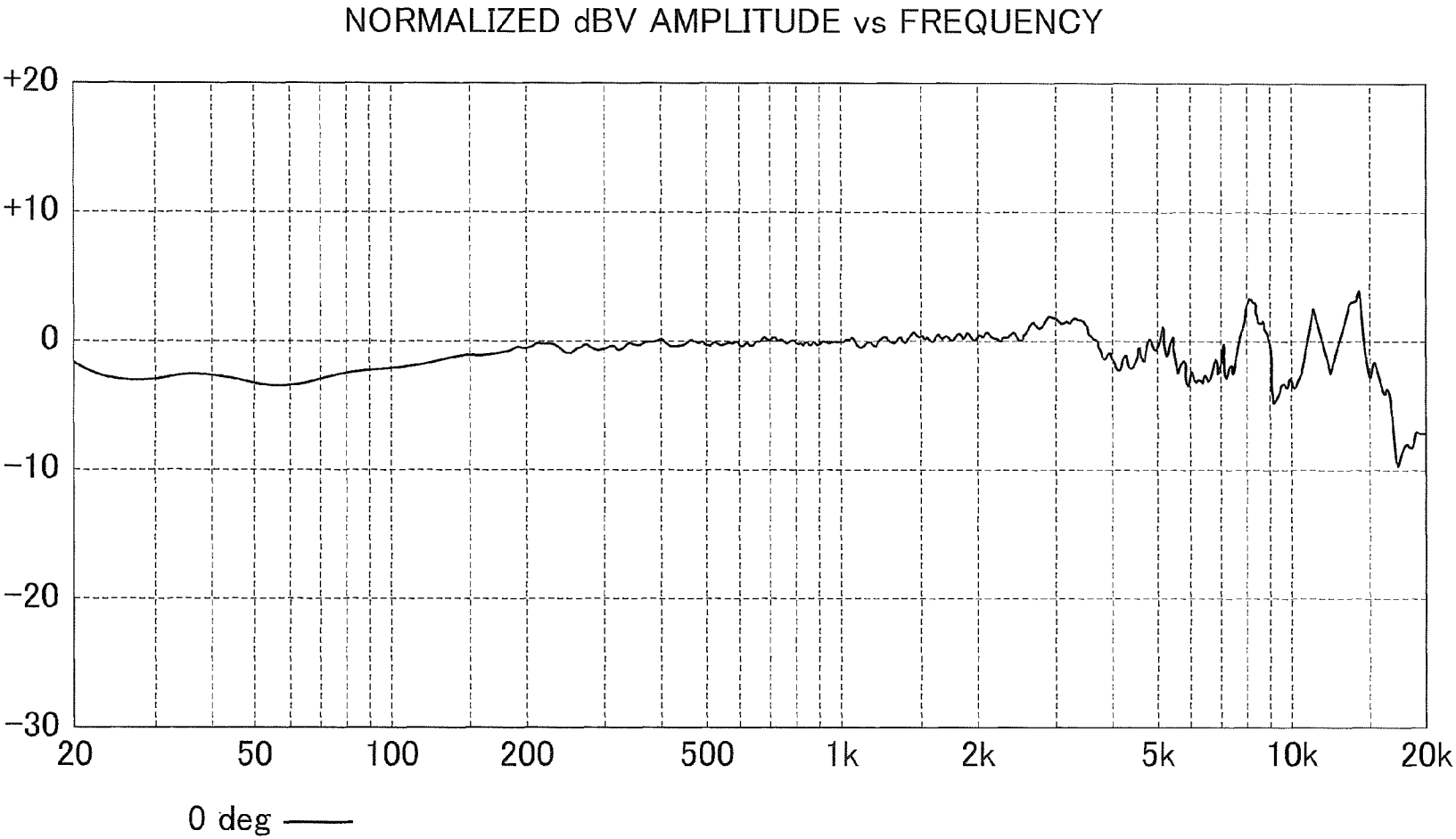
FIG. 7 is a graph illustrating frequency response characteristics when each wiper of the twin variable resistor is positioned on the positive end in the embodiment.

FIG. 7 illustrates typical frequency response characteristics of the condenser microphone 10 during increases in the output signals of the first and second condenser microphone units 11 and 12. This drawing illustrates that the output level is about 6 dB higher than that in FIG. 6 illustrating the frequency response characteristics of the first and second wipers 153 and 154 at the middle position.

Figure 4:
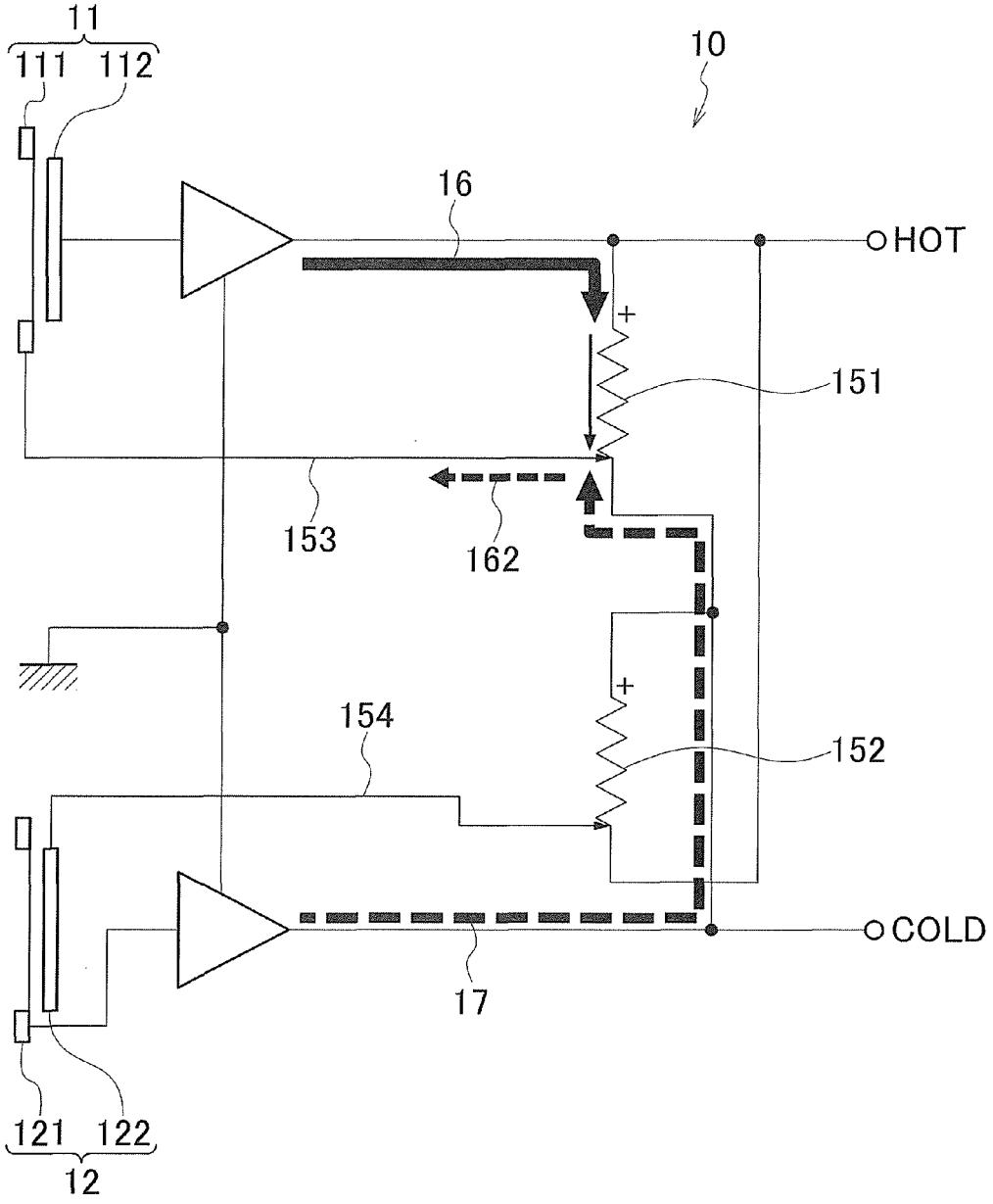
FIG. 4 is a circuit diagram illustrating an operation when each wiper of the twin variable resistor is shifted toward the other terminal of the variable resister in the embodiment.
Figure 5:
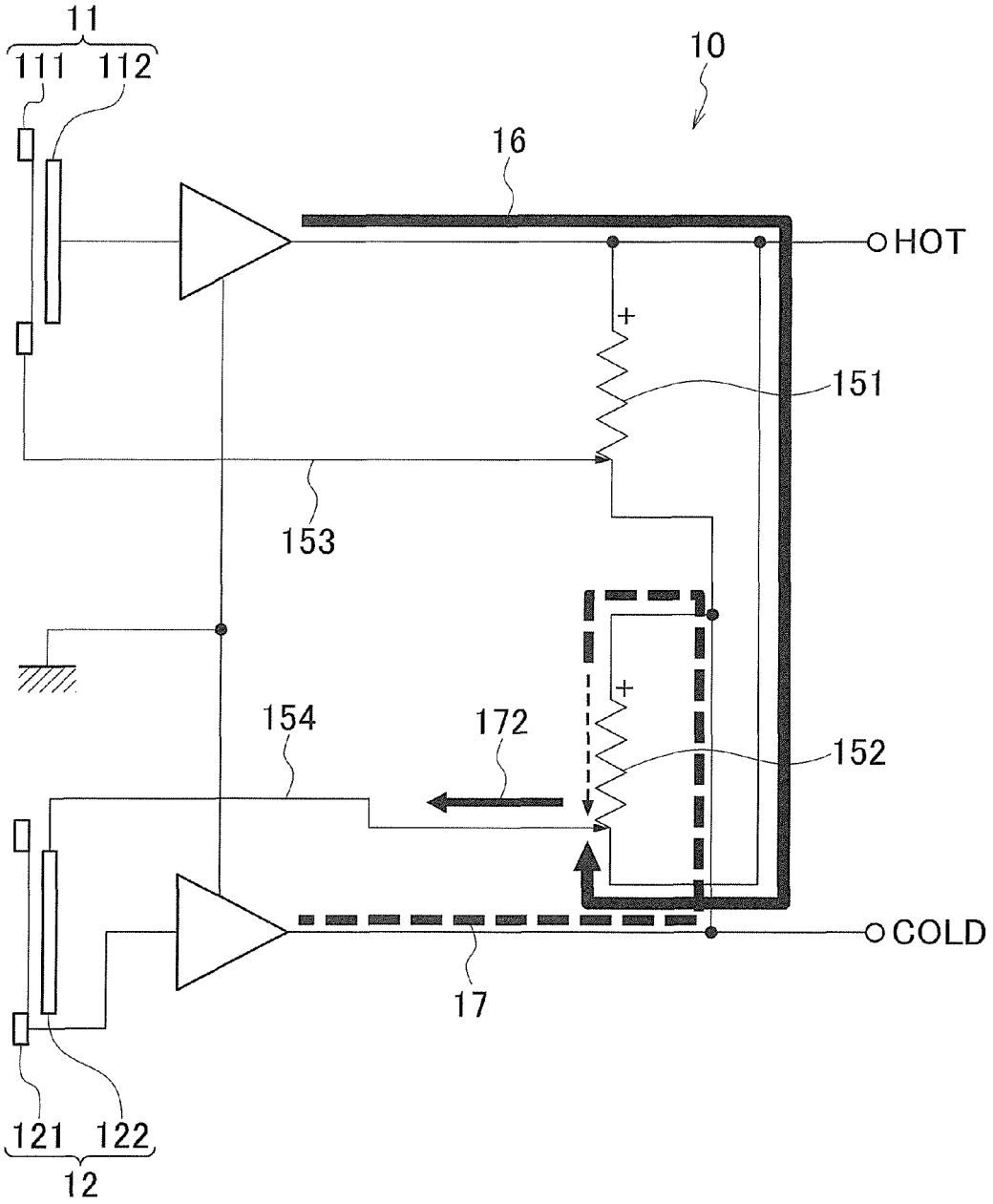
FIG. 5 is a circuit diagram illustrating another operation when each wiper of the twin variable resistor is shifted toward the other terminal of the variable resister in the embodiment.

FIGS. 4 and 5 illustrate exemplary states of the condenser microphone 10 after the first and second wipers 153 and 154 are shifted to the negative ends. As illustrated in FIG. 4, after the first wiper 153 is shifted to the negative end, the first variable resistor 151 applies a maximum resistance value to the output signal 16 and a minimum resistance value to the output signal 17. As a result, the output signal 16 of the first condenser microphone unit 11 is combined at a maximum proportion of the output signal of the second condenser microphone unit 12 having a phase opposite to the output signal 16. The resultant composite signal 162 is then applied to the diaphragm 111 of the first condenser microphone unit 11 from the first wiper 153 of the first variable resistor 151. This decreases the output level from the fixed electrode 112 of the first condenser microphone unit 11.

As illustrated in FIG. 5, after the second wiper 154 is shifted to the negative end, the second variable resistor 152 applies a minimum resistance value to the output signal 16 and a maximum resistance value to the output signal 17. At this time, a composite signal 172 to be applied to the fixed electrode 122 from the second wiper 154 is combined at a maximum proportion of output signal of the first condenser microphone unit 11 having phases opposite to the output signal 17 of the second condenser microphone unit 12. This decreases the output level from the diaphragm 121 of the second condenser microphone unit 12.

In this way, the shift of the first wiper 153 toward the negative end increases the resistance value of the first variable resistor 151 in accordance with the output signal of the first condenser microphone unit 11, leading to the shift of the second wiper 154 toward the negative end together. This decreases the resistance value of the first variable resistor 151 in accordance with the output signal of the second condenser microphone unit 12, decreases the resistance value of the second variable resistor 152 in accordance with the output signal of the first condenser microphone unit 11, and increases the resistance value of the second variable resistor 152 in accordance with the output signal of the second condenser microphone unit 12. That is, a change in the resistance value of the twin variable resistor 15 can continuously decrease the levels of the input signals to the first impedance converter 13 and the input signal to the second impedance converter 14.

Figure 8:
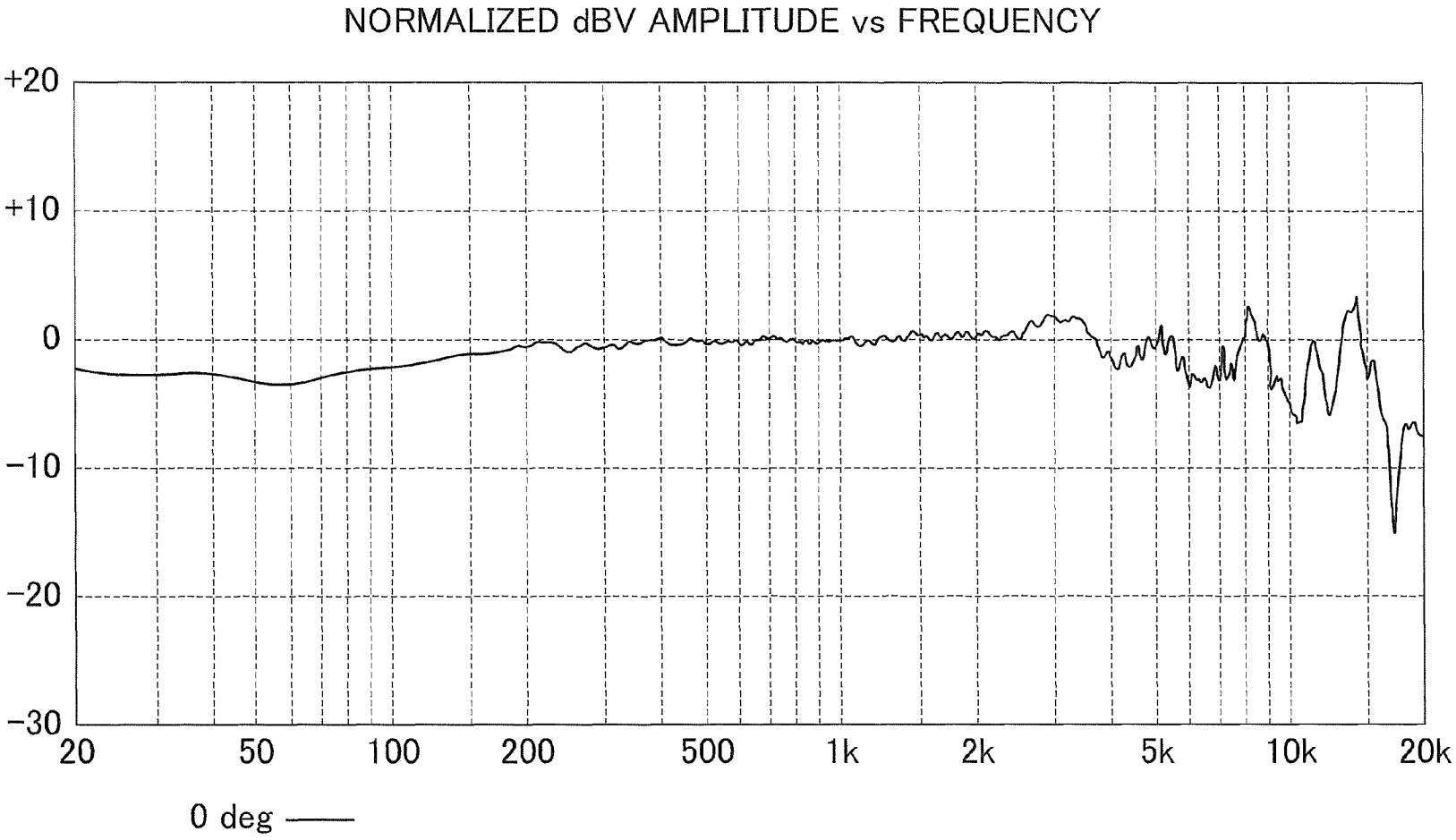
FIG. 8 is a graph illustrating frequency response characteristics when each wiper of the twin variable resistor is positioned on the negative end in the embodiment.
Figure 9:
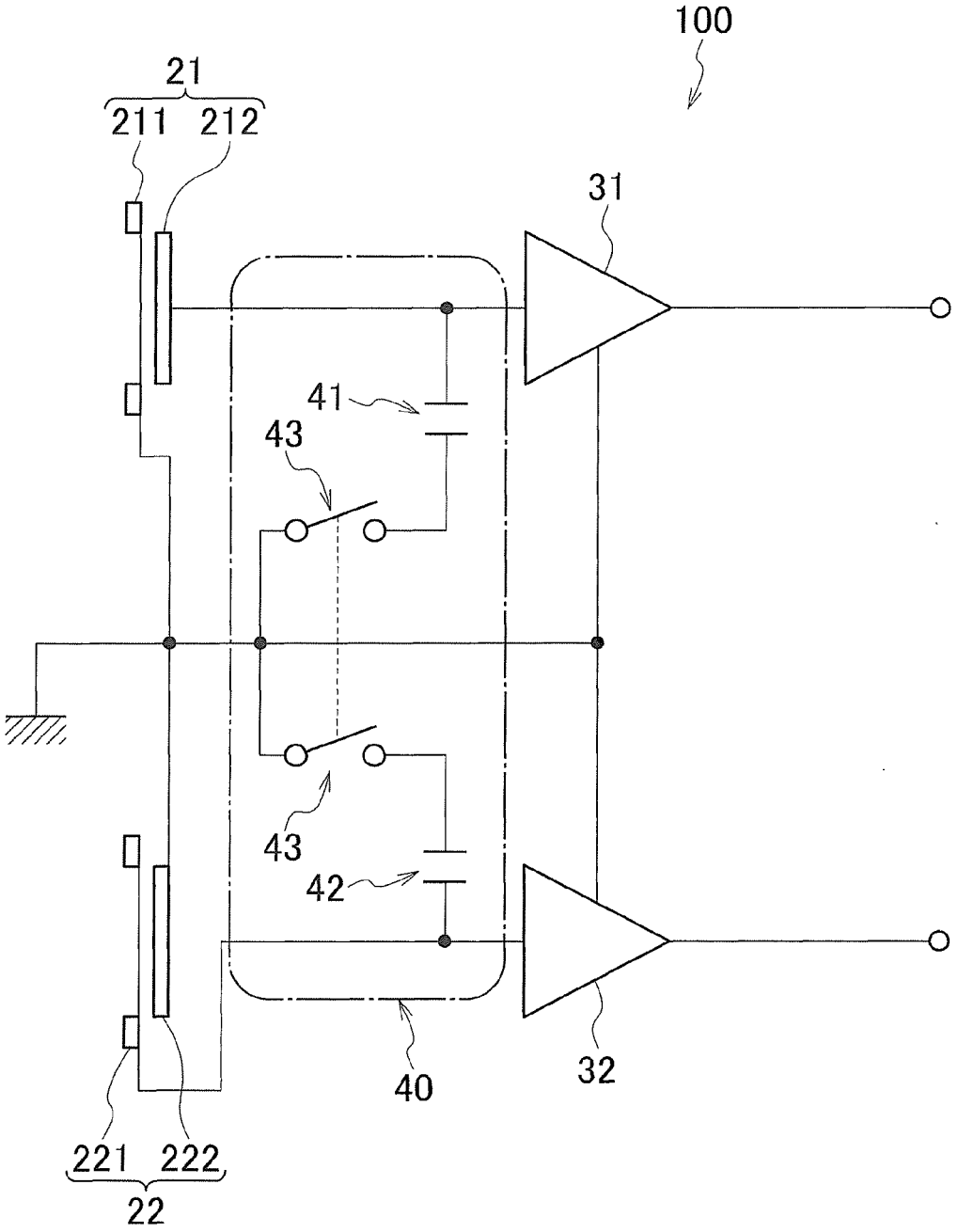
RELATED ART FIG. 9
FIG. 9 is an example circuit diagram illustrating a conventional condenser microphone.

FIG. 8 illustrates typical frequency response characteristics of the condenser microphone 10 during decreases in the output signals of the first and second condenser microphone units 11 and 12. This drawing illustrates that the output level is about 6 dB lower than that in FIG. 6 illustrating the frequency response characteristics of the first and second wipers 153 and 154 at the middle position.

As mentioned above, if a low level of sound waves is inputted to the condenser microphone 10, the shift of the first and second wipers 153 and 154 of the variable resistor 15 toward the positive end increases the levels of the input signals to the impedance converters. This increases the levels of the balanced output signals outputted from the hot and cold terminals. A high input signal level to the impedance converter does not vary the noise level inherent in the impedance converter. This can produce a suitable output level without deterioration of the signal-to-noise ratio.

Moreover, the twin variable resistor 15 can provide the same advantageous effect as that of conventional pads. The twin variable resistor 15 can decrease the input levels to the first and second impedance converters 13 and 14, prevent distortion of the balanced output signals outputted from the hot and cold terminals, and produce suitable output signals.

According to the condenser microphone 10 in the present embodiment, the twin variable resistor 15 can continuously vary the input signal levels to the first and second impedance converters 13 and 14 within the range of, for example, −6 dB to +6 dB. This can provide a condenser microphone capable of attenuating an excess input signal level and amplifying an excessively low input signal level without a variation in signal-to-noise ratio.

What is claimed is:

1. A condenser microphone comprising:

a first condenser microphone unit and a second condenser microphone unit that generate output signals having phases opposite to each other; and a twin variable resistor comprising a first variable resistor and a second variable resistor, wherein an output terminal of the first condenser microphone unit is connected to a first terminal of the first variable resistor, a second terminal of the second variable resistor, and a first terminal of a balanced output, an output terminal of the second condenser microphone unit is connected to a second terminal of the first variable resistor, a first terminal of the second variable resistor, and a second terminal of the balanced output, a wiper of the first variable resistor is connected to a diaphragm of the first condenser microphone unit, and a wiper of the second variable resistor is connected to a fixed electrode of the second condenser microphone unit.

2. The condenser microphone according to claim 1, wherein the first condenser microphone unit includes a fixed electrode outputting first output signals, and the second condenser microphone unit includes a diaphragm outputting second output signals.

3. The condenser microphone according to claim 1, wherein the first output signals of the first condenser microphone unit and the second output signals of the second condenser microphone unit are combined in response to the position of the wiper of the first variable resistor to generate a first composite signal, the first composite signal being applied to the diaphragm of the first condenser microphone unit, and the first output signals of the first condenser microphone unit and the second output signals of the second condenser microphone unit are also combined in response to the position of the wiper of the second variable resistor to generate a second composite signal, the second composite signal being applied to the fixed electrode of the second condenser microphone unit.

4. The condenser microphone according to claim 3, wherein when the wiper of the first variable resistor is positioned where the first composite signal applied to the diaphragm of the first condenser microphone unit increases the output signal of the first condenser microphone unit, the wiper of the second variable resistor is positioned where the second composite signal applied to the fixed electrode of the second condenser microphone unit increases the output signal of the second condenser microphone unit.

5. The condenser microphone according to claim 3, wherein when the wiper of the first variable resistor is positioned where the first composite signal applied to the diaphragm of the first condenser microphone unit decreases the output signal of the first condenser microphone unit, the wiper of the second variable resistor is positioned where the second composite signal applied to the fixed electrode of the second condenser microphone unit decreases the output signal of the second condenser microphone unit.

6. The condenser microphone according to claim 1, wherein when the wiper of the first variable resistor is positioned so as to minimize the resistance value of the first variable resistor in accordance with the output signal of the first condenser microphone unit, the wiper of the second variable resistor is positioned so as to maximize the resistance value of the second variable resistor in accordance with the output signal of the first condenser microphone unit, and when the wiper of the first variable resistor is positioned so as to maximize the resistance value of the first variable resistor in accordance with the output signal of the first condenser microphone unit, the wiper of the second variable resistor is positioned so as to minimize the resistance value of the second variable resistor in accordance with the output signal of the first condenser microphone unit.

7. The condenser microphone according to claim 1, wherein when the wiper of the first variable resistor is positioned so as to maximize the resistance value of the first variable resistor in accordance with the output signal of the second condenser microphone unit, the wiper of the second variable resistor is positioned so as to minimize the resistance value of the second variable resistor in accordance with the output signal of the second condenser microphone unit, and when the wiper of the first variable resistor is positioned so as to minimize the resistance value of the first variable resistor in accordance with the output signal of the second condenser microphone unit, the wiper of the second variable resistor is positioned so as to maximize the resistance value of the second variable resistor in accordance with the output signal of the second condenser microphone unit.

8. The condenser microphone according to claim 1, wherein the output terminal of the first condenser microphone unit is connected to the first terminal of the balanced output as a hot terminal and the output terminal of the second condenser microphone unit is connected to the second terminal of the balanced output as a cold terminal.

* * * * *